US009370287B2

(12) United States Patent
Welchert

(10) Patent No.: US 9,370,287 B2
(45) Date of Patent: Jun. 21, 2016

(54) WET/DRY VACUUM HOSE ATTACHMENT

(71) Applicant: Joseph Welchert, Scottsdale, AZ (US)

(72) Inventor: Joseph Welchert, Scottsdale, AZ (US)

( * ) Notice: Subject to any disclaimer, the term of this patent is extended or adjusted under 35 U.S.C. 154(b) by 0 days.

(21) Appl. No.: 14/247,596

(22) Filed: Apr. 8, 2014

(65) Prior Publication Data

US 2014/0346767 A1 Nov. 27, 2014

Related U.S. Application Data

(63) Continuation-in-part of application No. 13/348,483, filed on Jan. 11, 2012, now Pat. No. 8,777,272.

(60) Provisional application No. 61/431,648, filed on Jan. 11, 2011.

(51) Int. Cl.
*A47L 9/24* (2006.01)

(52) U.S. Cl.
CPC ..... *A47L 9/248* (2013.01)

(58) Field of Classification Search
CPC ..... A47L 9/248
USPC ..... 285/7, 12; 15/414, 415.1
See application file for complete search history.

(56) References Cited

U.S. PATENT DOCUMENTS

| | | | | |
|---|---|---|---|---|
| 1,752,664 | A | 4/1930 | Forcier | |
| 3,408,091 | A | 10/1968 | Zylstra | |
| 3,781,941 | A | 1/1974 | Macfarland | |
| 4,053,962 | A | 10/1977 | McDowell | |
| 4,114,230 | A | 9/1978 | MacFarland | |
| 4,191,407 | A | 3/1980 | Bretone, Jr. | |
| 4,318,547 | A | 3/1982 | Ericson | |
| 4,476,607 | A | 10/1984 | Ross | |
| 4,479,281 | A | 10/1984 | Mikutowski | |
| 4,553,284 | A | 11/1985 | Strumbos | |
| 4,714,279 | A | 12/1987 | Custeau | |
| 4,763,932 | A | 8/1988 | Matz et al. | |
| 5,042,844 | A | 8/1991 | Iida et al. | |
| 5,050,266 | A | 9/1991 | Schneider | |
| 5,054,160 | A | 10/1991 | Marino | |
| RE34,325 | E | 7/1993 | Rau et al. | |
| 5,452,493 | A | 9/1995 | Galindo | |
| 5,598,867 | A | 2/1997 | Sullivan | |
| 5,915,406 | A | 6/1999 | Traylor | |
| 6,394,505 | B1 | 5/2002 | Schmucki et al. | |
| 6,976,710 | B1 | 12/2005 | Bedford | |
| 7,559,581 | B2 | 7/2009 | Saito et al. | |
| 8,113,543 | B1 | 2/2012 | Romaini et al. | |
| 8,167,337 | B2 | 5/2012 | Bruno et al. | |
| 8,777,272 | B2 * | 7/2014 | Welchert | 285/7 |

* cited by examiner

*Primary Examiner* — David E Bochna
(74) *Attorney, Agent, or Firm* — Barbara J. Luther

(57) ABSTRACT

A vacuum attachment for reaching smaller spaces includes a gasket and narrow tubing. The gasket has a cap with outer and middle walls sized to fit an open end of two sizes of vacuum hose, the cap also having a central hole for the narrow tube. The gasket middle wall also stiffens the gasket. On the internal sides of the walls, the ribs stiffen the gasket and ridges let air pass and reduce pressure build up in a vacuum motor. The narrow, bendable tube has sufficiently thick walls to avoid collapse when a vacuum is applied thereto.

18 Claims, 6 Drawing Sheets

WET/DRY VACUUM HOSE ATTACHMENT

RELATED APPLICATIONS

This application is a continuation in part of U.S. Nonprovisional patent application Ser. No. 13/348,483, filed Jan. 11, 2012, and issued Jul. 15, 2014, as U.S. Pat. No. 8,777,272 and claims the benefit of U.S. Provisional Patent Application No. 61/431,648, filed on Jan. 11, 2011.

FIELD OF THE INVENTION

This invention relates to vacuum cleaners, and more specifically, to an attachment for wet/dry vacuums which is flexible to allow for cleaning of narrow spaces.

BACKGROUND OF THE INVENTION

Vacuum cleaners that may be used to collect both wet and dry material, commonly referred to as wet/dry vacuums or wet/dry "vacs," are well known. Wet/dry vacs are often used in workshops and or other areas where both wet and dry debris may accumulate.

Wet/dry vacs generally consist of a collection tank or canister and a cover or lid upon which a motor and impeller assembly is mounted. The motor and impeller assembly creates suction within the canister, such that debris and liquid are drawn into the canister through an air inlet to which a hose may be attached. A filter within the canister prevents incoming debris from escaping from the canister while allowing filtered air to escape.

Different attachments may be connected to the hose to allow the wet/dry vacuum to clean different areas. In general, these attachments are formed or a rigid plastic material.

A need existed to provide a device and method to overcome the problems of existing devices.

SUMMARY OF THE INVENTION

In one embodiment, there is provided a vacuum attachment for reaching smaller spaces, the attachment comprising a gasket and at least one narrow bendable tube. The gasket has i. a cap member sized to fit over an open end of a vacuum hose, the cap member having an inner surface and a central hole to accommodate a narrow tube; ii. an inner wall extending from the central hole of the cap and gripping the narrow tube; iii. an outer wall extending from the cap member to a distal edge and accommodating the vacuum hose; iv. a middle wall between the inner and outer walls, the middle wall stiffening the gasket for more convenient and accommodating an additional size of vacuum hose, the outer and middle walls being equipped with ribs on the internal sides of the walls, the ribs extending from the cap to the distal ends of the walls; and v. the cap member's inner surface having a plurality of ridges that extend laterally from the inner wall to the middle wall and from the middle wall, the ridges being so designed as to let air pass and reduce pressure build up in a vacuum motor. The at least one narrow, bendable tube is fashioned to fit into the central hole of the cap member and has sufficiently thick walls to avoid collapse when a vacuum is applied thereto.

Optionally, the at least one narrow tube is thick-walled and flexible and is made of vinyl or polyethylene. Optionally, the vacuum attachment provides four narrow tubes, a first tube that fits inside the inner wall, a second tube that fits inside the first tube, a third tube that fits inside the second tube and a fourth tube that fits inside the third tube. In one embodiment, the first tube is about 61 cm (two feet) in length, about 1.6 cm (⅝ inch) interior diameter and fits into the central hole of the cap member. Optionally, the second tube is about 30 cm (one foot) in length and has a 1.3 cm (½ inch) interior diameter. Optionally, the third tube has a length of about 30 cm (one foot) and an interior diameter of about 0.95 cm (⅜ inch). Optionally, the fourth tube of has a length of about 30 cm (one foot) and an interior diameter of about 0.7 cm (¼ inch).

Preferably, the gasket is made of thick rubber. Optionally, the gasket has middle and outer walls sized to accommodate vacuum hoses of about 3.2 cm (1¼ inch), 3.8 cm (1½ inch), 4.8 cm (1⅞ inch) and about 6.35 cm (2½ inch).

In another embodiment, a vacuum attachment for reaching smaller spaces includes a gasket and a narrow bendable tube. The gasket includes i. a cap sized to fit over an open end of a vacuum hose, the cap member having a top surface and a central hole to accommodate a narrow tube, the top surface having at least one hole to relieve pressure; ii. an inner wall extending from the central hole of the cap and gripping the narrow tube; iii. an outer wall extending from the cap member and accommodating the vacuum hose; iv. a middle wall between the inner and outer walls, the middle wall stiffening the gasket for more convenient and accommodating an additional size of vacuum hose, the outer and middle walls being equipped with ribs on the internal sides of the walls, the ribs extending from the cap to the distal ends of the walls; and v. the cap member's inner surface having a plurality of ridges that extend laterally from the inner wall to the middle wall and from the middle wall, the ridges being so designed as to let air pass and reduce pressure build up in a vacuum motor. The at least one narrow, bendable tube is fashioned to fit into the central hole of the cap member and has sufficiently thick walls to avoid collapse when a vacuum is applied thereto.

Optionally, the at least one narrow tube is made of vinyl or polyethylene and is thick-walled and flexible. Optionally, the vacuum attachment includes four narrow tubes, a first tube that fits inside the inner wall, a second tube that fits inside the first tube, a third tube that fits inside the second tube and a fourth tube that fits inside the third tube. Optionally, the first tube is about 61 cm (two foot) in length, about 1.6 cm (⅝ inch) in interior diameter and fits into the central hole of the cap member. Optionally, the second tube is about 30 cm (one foot) in length and has a 1.3 cm (½ inch) interior diameter. Optionally, the third tube has a length of about 30 cm (one foot) and an interior diameter of about 0.95 cm (⅜ inch). Optionally, the fourth tube has a length of about 30 cm (one foot) and an interior diameter of about 0.7 cm (¼ inch). Preferably the gasket is made of thick rubber. Preferably the gasket is provided in two outer wall diameters to accommodate vacuum hoses of about 3.2 cm (1¼ inch), 3.8 cm (1½ inch), 4.8 cm (1⅞ inch) and 6.35 (2½ inch).

BRIEF DESCRIPTION OF THE DRAWINGS

Common reference numerals are used throughout the drawings and detailed description to indicate like elements.

DETAILED DESCRIPTION

I have found that the prior art vacuum attachments did not conveniently perform the jobs I needed done. The different available attachments are made out of rigid materials that have limitations. First, since current attachments are not flexible, current wet/dry vacuums cannot be used to clean in narrow openings, curved areas, P-traps to remove blockages, and the like. Further, current attachments do not allow for one to connect the hose to copper tubing, valves, and the like in order to drain fluids from different devices.

My new attachment provides several advantages. First, the attachment comprises a gasket and at least one narrow tubing. The gasket is a soft but firm material to stretch to the hose size. Second, the attachment enables the use of small diameter tubing, which allows for cleaning in narrow openings, curved areas, and the like. Third, another embodiment has cap internal ridges to offset the vacuum hose and permit breathability (less build up of pressure). Fourth, tubing slides into the rubber gasket, a configuration that diminishes trapping of collected materials. Fifth, the included tubing has relatively thick walls to avoid the collapse seen when a vacuum force is applied to weaker-walled tubing. The attachment further allows a wet/dry vacuum to be attached to piping, gate valves, and the like for draining of fluids from different apparatuses. The attachment also allows for the wet/dry vacuum to be attached to inflatable items like air mattresses and the like in order to inflate and or deflate the aforementioned. The attachment further allows for the wet/dry vacuum to be used in P-traps to remove blockages and the like. The above advantages of the attachment are not all-inclusive and should not be seen in a limiting manner.

Figure 1:
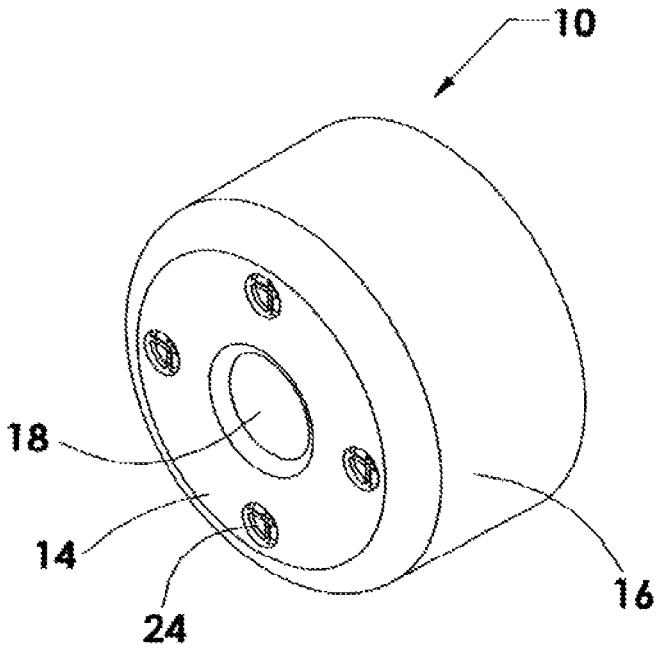
FIG. 1 is a perspective view of one embodiment of the present invention.
Figure 2:
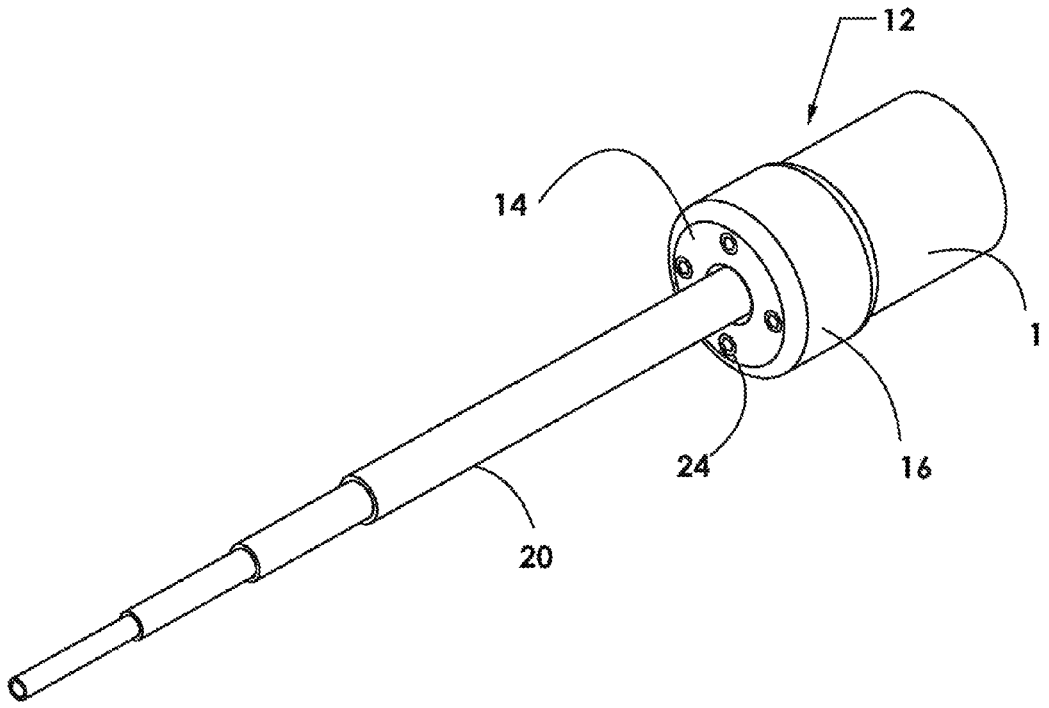
FIG. 2 is a perspective view of the embodiment of FIG. 1 with the flexible tube attached.
Figure 4:
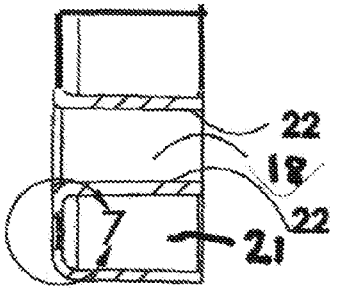
FIG. 4 is a cross-sectional view taken along lines 4-4 of FIG. 3.
Figure 3:
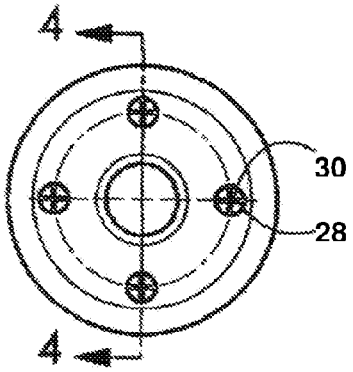
FIG. 3 is a front view of the embodiment of FIG. 1.
Figure 5:
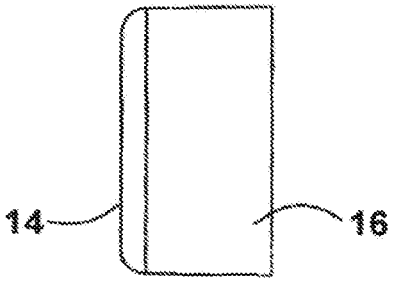
FIG. 5 is a side view of the embodiment of FIG. 1.
Figure 6:
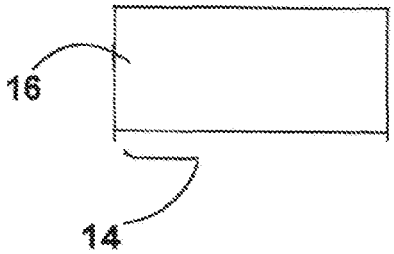
FIG. 6 is a rotated side view of the embodiment of FIG. 1.
Figure 7:
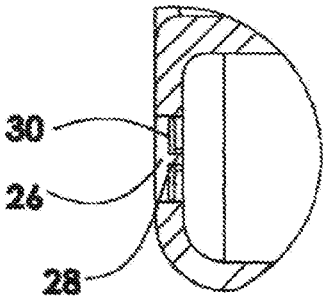
FIG. 7 is a magnified view of a portion of the present invention as shown in FIG. 4.

Referring now to FIG. 1, a wet/dry vacuum attachment gasket 10 is shown. The gasket 10 is connected to an existing hose on a wet/dry vacuum (not shown). The attachment 10 is comprised of a cap member 14. The cap member 14 is sized to fit over an open end of the existing hose 1 of a wet/dry vacuum. The cap member 14 has a top surface (where the numeral 14 appears). In the present embodiment, the cap member 14 is circular in nature. However, the shape of the cap member 14 is not limiting manner.

Outer wall 16 extend (distally) away from the cap member 14. The wall 16 extends away from an outer perimeter of the cap member 14. In accordance with one embodiment of the present invention, the outer wall 16 extends approximately 3.8 centimeters (cm) (1.5 inches) from the cap member 14. The outer wall 16 is used to firmly secure the gasket 10 to the open end of the hose 1 of the dry/wet vacuum.

An opening 18 is formed in a central area of the cap member 14. The opening 18 is sized to accommodate a flexible tubing 20. In order to secure the flexible tubing 20, inner wall 22 extends away from the perimeter of the opening 18. The inner wall 22 extends approximately 3.8 cm (1.5 inches) from the opening 18 in the cap member 14. In operation, the flexible tubing 20 is inserted into the opening 18 down a channel formed by the inner wall 22. This secures the flexible tubing 20 within the cap member 14. Also included in the attachment kit is at least one additional narrower tube (not shown) that can be inserted inside the flexible tubing 20. To vacuum even smaller spaces, one or more additional narrower tubes can be inserted into the preceding narrower tube(s). The diameters and lengths of the wall are readily adjustable to any standard size of vacuum hose.

In one embodiment, one or more pressure openings 24 are formed in the cap member 14. The pressure openings 24 may be slits or the like formed through the cap member 14. The pressure openings 24 may be used to ensure that excessive pressure does not build up within a motor (not shown) of the wet/dry vacuum.

In the embodiment shown in FIGS. 1-4, the pressure openings 24 are formed of a circular layer 26 removed from the top surface of the cap member 14. A pair of slits 28 is formed in the area below where the circular layer 26 was removed. The slits 28 form a "+" pattern but this should not be seen in a limiting fashion. The slits 28 form flap members 30. As pressure may build up with the wet/dry vacuum due to blockage or slow flow through the narrow flexible tubing(s) 20 and or hose 1, the flap members 30 bend inward to allow more air to flow through the cap member 14, thereby relieving pressure build-up and preventing damage to the motor of the wet/dry vacuum. In a similar manner, if the wet/dry vacuum is being used to blow air out of the hose 1 such as when the flex tubing 20 is attached to an inflatable item, the flap members 30 may bend outward to allow more air to flow out through the cap member 14, thereby relieving pressure build-up and preventing damage to the motor of the wet/dry vacuum.

Figure 8:
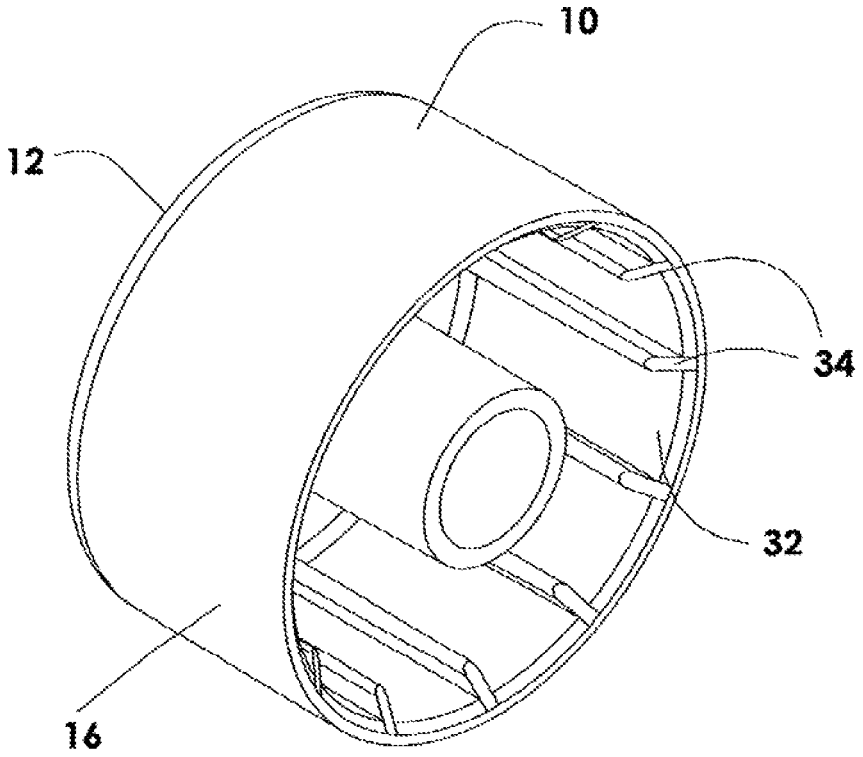
FIG. 8 is a perspective view of another embodiment with internal ribs in the outer wall to offset the vacuum hose and reduce unwanted pressure build up.
Figure 9:
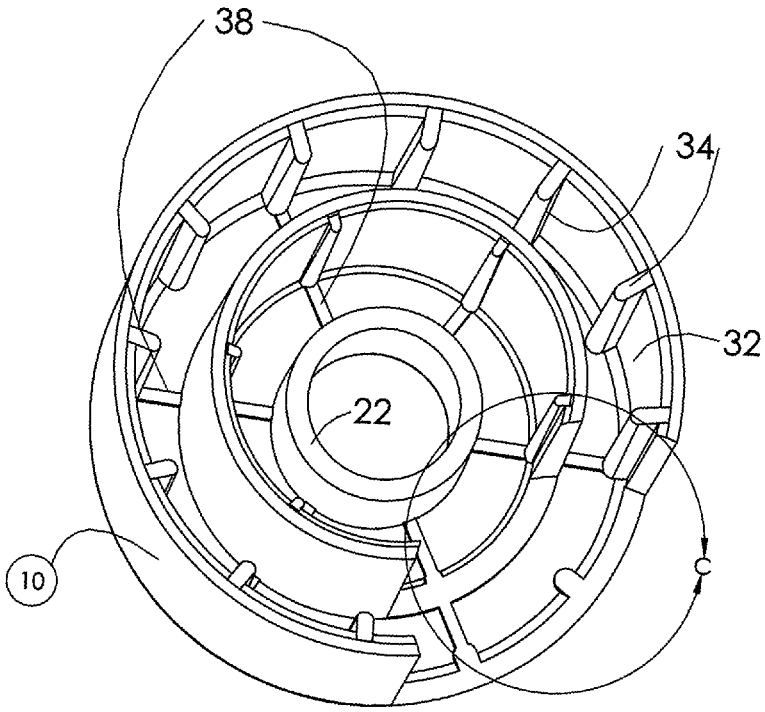
FIG. 9 is a perspective view of a variation of FIG. 8 with an additional middle wall, shown in cutaway.
Figure 10:
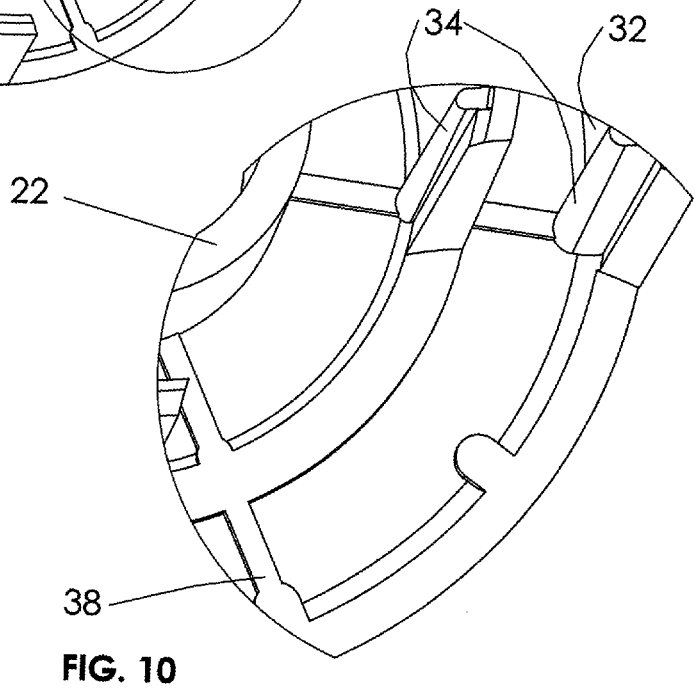
FIG. 10 is a magnification of circle C in FIG. 9.

In a preferred embodiment, pressure build-up is handled in another way. Rather than slits 28 with flaps 30, as disclosed above, FIGS. 8 and 9 show the gasket 10 has an outer wall 16 whose inner side 32 has ribs 34 that extend the length of the walls and onto the inner surface of the cap member 14 in the form of ridges 38. The ribs 34 serve to both grip variable sizes of the vacuum hose 1 and to maintain a space between the vacuum hose and the inner surface of the outer wall 16. This space permits some air to pass so that pressure does not build up and harm the vacuum engine. Advantageously this configuration directs the air away from the operator for safer operation. FIG. 10 is a close up of circle C in FIG. 9. In FIG. 10, the ribs 34 and ridges 38 are more prominently displayed.

Figure 11:
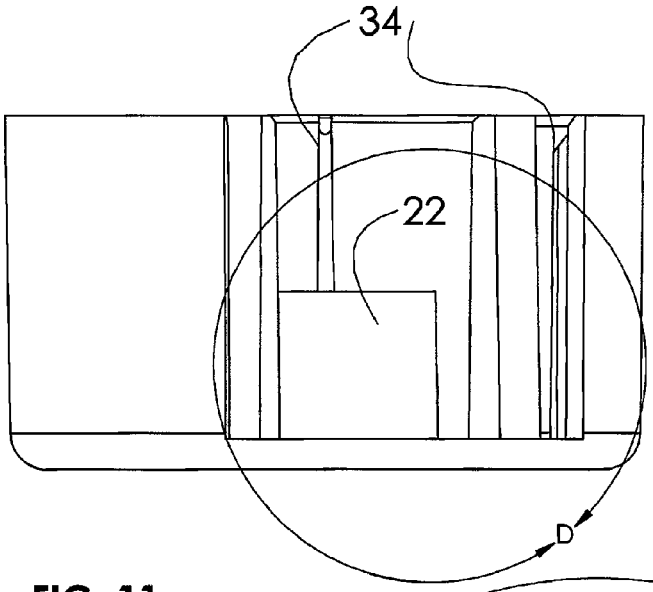
FIG. 11 is a side view of the cutaway gasket in FIG. 9.
Figure 12:
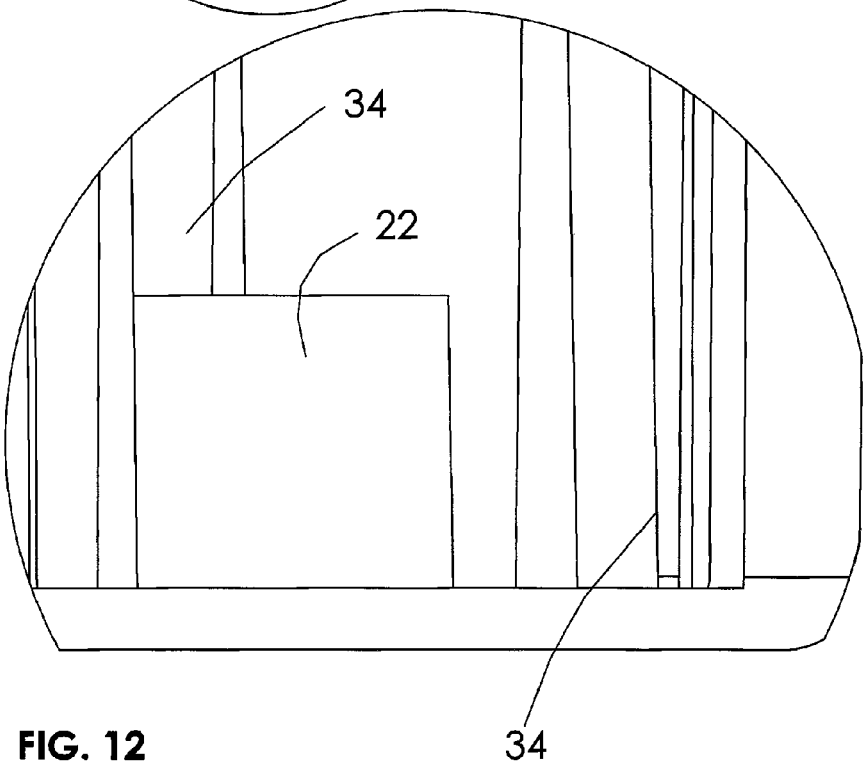
FIG. 12 is a magnification of circle D in FIG. 11.

FIG. 11 is a side view of the gasket shown in cutaway FIG. 9. In this view, it can be seen that central inner wall 22 is shorter than the outer walls. I discovered that my thick inner wall 22 worked just effectively when shortened, resulting in a savings of rubber. FIG. 12 is a magnification of FIG. 11's D circle. It too shows a shorter inner wall 22 and ribs 34.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

For the purposes of promoting an understanding of the principles of the invention, reference was made to the exemplary embodiments illustrated in the drawings, and specific language was used to describe the same. It will nevertheless be understood that no limitation of the scope of the invention is hereby intended.

Reference throughout this specification to an "embodiment," an "example" or similar language means that a particular feature, structure, characteristic, or combinations thereof described in connection with the embodiment is included in at least one embodiment of the present invention. Thus appearances of the phrases an "embodiment," and "example," and similar language throughout this specification may, but do not necessarily, all refer to the same embodiment, to different embodiments, or to one or more of the figures. Additionally, reference to the words "embodiment," "example" or the like for two or more features, elements, etc., does not mean that the features are necessarily related, dissimilar, the same, etc.

Each statement of an embodiment or example is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional un-recited elements or method steps. "Comprising" is to be interpreted broadly and including the more restrictive terms "consisting of" and "consisting essentially of."

Reference throughout this specification to features, advantages, or similar language does not imply that all of features and advantages that may be realized with the present invention should be or are in any single embodiment of the invention. Rather, language referring to the features and advantages is understood to mean that a specific feature, advantage or characteristic described in connection with an embodiment is included in at least one embodiment of the present invention. Thus, discussion of the features and advantages, and similar language, throughout this specification may, but does not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention. These features and advantages of the present invention will become more fully apparent from the description or may be learned by the practice of the invention as set forth.

The invention claimed is:

1. A vacuum attachment for reaching smaller spaces, the attachment comprising a. a gasket comprising i. a cap member sized to fit over an open end of a vacuum hose, the cap member having an inner surface and a central hole to accommodate a narrow tube;

ii. an inner wall extending from the central hole of the cap and gripping the narrow tube; and iii. an outer wall extending from the cap member to a distal edge and accommodating the vacuum hose;

iv. a middle wall between the inner and outer walls, the middle wall stiffening the gasket for more convenient operation and accommodating an additional size of vacuum hose, the outer and middle walls being equipped with ribs on the internal sides of the walls, the ribs extending from the cap to the distal ends of the walls; and v. the cap member inner surface having a plurality of ridges that extend radially from the inner wall to the middle wall, the ridges being so designed as to let air pass and reduce pressure build up in a vacuum motor; and b. at least one narrow, bendable tube fashioned to fit into the central hole of the cap member and having sufficiently thick walls to avoid collapse when a vacuum is applied thereto.

2. The vacuum attachment of claim 1, wherein at least one narrow tube comprises vinyl or polyethylene.

3. The vacuum attachment of claim 1 wherein the attachment provides four narrow tubes, a first tube that fits inside the inner wall, a second tube that fits inside the first tube, a third tube that fits inside the second tube and a fourth tube that fits inside the third tube.

4. The vacuum attachment of claim 3, wherein the first tube is about 61 cm (two feet) in length, and has about 1.6 cm (⅝ inch) interior diameter and fits into the central hole of the cap member.

5. The vacuum attachment of claim 3, wherein the second tube is about 30 cm (one foot) in length and has a 1.3 cm (½ inch) interior diameter.

6. The vacuum attachment of claim 3, wherein the third tube has a length of about 30 cm (one foot) and an interior diameter of about 0.95 cm (⅜ inch).

7. The vacuum attachment of claim 3, wherein the fourth tube has a length of about 30 cm (one foot) and an interior diameter of about 0.7 cm (¼ inch).

8. The vacuum attachment of claim 1, wherein the gasket comprises thick rubber.

9. The vacuum attachment of claim 1, wherein the gasket is provided in two outer wall diameters to accommodate vacuum hoses of about 3.2 cm (1¼ inch), 3.8 cm (1½ inch), 4.8 cm (1⅞ inch) and about 6.35 cm (2½ inch).

10. The vacuum attachment of claim 1, wherein the gasket comprises thick rubber.

11. The vacuum attachment of claim 1, wherein the gasket is provided in two outer wall diameters to accommodate vacuum hoses of about 3.2 cm (1¼ inch), 3.8 cm (1½ inch), 4.8 cm (1⅞ inch) and 6.35 (2½ inch).

12. A vacuum attachment for reaching smaller spaces, the attachment comprising a. a gasket comprising i. a cap sized to fit over an open end of a vacuum hose, the cap member having a top surface and a central hole to accommodate a narrow tube, the top surface having at least one hole to relieve pressure;

ii. an inner wall extending from the central hole of the cap and gripping the narrow tube;

iii. an outer wall extending from the cap member and accommodating the vacuum hose;

iv. a middle wall between the inner and outer walls, the middle wall stiffening the gasket for more convenient operation and accommodating an additional size of vacuum hose, the outer and middle walls being equipped with ribs on the internal sides of the walls, the ribs extending from the cap to the distal ends of the walls; and v. the cap member inner surface having a plurality of ridges that extend radially from the inner wall to the middle wall, the ridges being so designed as to let air pass and reduce pressure build up in a vacuum motor; and b. at least one narrow, bendable tube fashioned to fit into the central hole of the cap member and having sufficiently thick walls to avoid collapse when a vacuum is applied thereto.

13. The vacuum attachment of claim 12, wherein the at least one narrow tube further comprises vinyl or polyethylene.

14. The vacuum attachment of claim 12 wherein the attachment provides four narrow tubes, a first tube that fits inside the inner wall, a second tube that first inside the first tube, a third tube that fits inside the second tube and a fourth tube that fits inside the third tube.

15. The vacuum attachment of claim 14, wherein the first tube is about 61 cm (two feet) in length, and has about 1.6 cm (⅝ inch) interior diameter and fits into the central hole of the cap member.

16. The vacuum attachment of claim 14, wherein the second tube is about 30 cm (one foot) in length and has a 1.3 cm (½ inch) interior diameter.

17. The vacuum attachment of claim 14, wherein the third tube has a length of about 30 cm (one foot) and an interior diameter of about 0.95 cm (⅜ inch).

18. The vacuum attachment of claim 14, wherein the fourth tube has a length of about 30 cm (one foot) and an interior diameter of about 0.7 cm (¼ inch).

* * * * *